US005167945A

United States Patent [19]

Ogawa et al.

[11] Patent Number: 5,167,945

[45] Date of Patent: Dec. 1, 1992

[54] METHOD FOR PRODUCING GRAPHITE FIBER

[75] Inventors: Hiroyasu Ogawa; Tetsuro Shigei, both of Shizuoka; Tomoaki Kanno, Kanagawa, all of Japan

[73] Assignee: Toho Rayon Co., Ltd., Tokyo, Japan

[21] Appl. No.: 600,894

[22] Filed: Oct. 22, 1990

Related U.S. Application Data

[63] Continuation-in-part of Ser. No. 244,892, Sep. 15, 1988, abandoned, which is a continuation-in-part of Ser. No. 120,671, Nov. 12, 1987, abandoned, which is a continuation of Ser. No. 845,167, Mar. 27, 1988, abandoned.

[30] Foreign Application Priority Data

Mar. 27, 1985 [JP] Japan ..... 60-60816

[51] Int. Cl.[5] ..... C01B 31/04

[52] U.S. Cl. ..... 423/448; 423/447.1; 423/447.2; 423/447.4; 423/447.6; 423/460; 264/292

[58] Field of Search ..... 423/447.1, 447.2, 447.4, 423/447.6, 448, 460; 264/29.2

[56] References Cited

U.S. PATENT DOCUMENTS

| | | | |
|---|---|---|---|
| 3,617,220 | 11/1971 | Moore et al. | 423/447.5 |
| 3,894,884 | 7/1975 | Druin et al. | 423/447.2 |
| 4,009,248 | 2/1977 | Kishimoto et al. | 423/447.6 |
| 4,259,307 | 3/1981 | Marayama, I | 423/447.4 |
| 4,284,615 | 8/1981 | Marayama, II | 423/447.6 |
| 4,452,601 | 6/1984 | Collins et al. | 423/447.5 |
| 4,496,631 | 1/1985 | Adachi et al. | 423/447.1 |
| 4,536,448 | 8/1985 | Ogawa et al. | 264/29.2 |
| 4,609,540 | 9/1986 | Izumi et al. | 423/447.2 |

FOREIGN PATENT DOCUMENTS

| | | | |
|---|---|---|---|
| 0102705 | 3/1984 | European Pat. Off. | 423/447.2 |
| 47-22665 | 6/1972 | Japan | 423/447.6 |
| 49-19128 | 2/1974 | Japan | 423/447.1 |
| 52-34025 | 3/1977 | Japan | 423/447.2 |
| 54-131032 | 10/1979 | Japan | 264/29.2 |
| 59-199872 | 11/1983 | Japan | 423/447.4 |

*Primary Examiner*—Robert Kunemund

*Attorney, Agent, or Firm*—Sughrue, Mion, Zinn, Macpeak & Seas

[57] ABSTRACT

A method for producing graphite fiber comprising graphitizing carbon fiber having a strength of 500 kgf/mm$^2$ or more and a modulus of elasticity of from 27,000 to 33,000 kgf/mm$^2$, and having at least on the surface of the fibers, from 0.2 to 2% by weight of an epoxy resin as a sizing agent, from 0.005 to 0.10% by weight of silicon and 0.005 to 0.02% by weight of phosphorus based on the weight of carbon fiber having said epoxy resin, silicon and phosphorus.

16 Claims, No Drawings

METHOD FOR PRODUCING GRAPHITE FIBER

CROSS REFERENCE TO RELATED APPLICATIONS

This application is a continuation-in-part of U.S. Ser. No. 07/244,892 filed Sep. 15, 1988, now abandoned, which is a continuation-in-part of U.S. Ser. No. 07/120,671 filed Nov. 12, 1987 (now abandoned) which in turn is a continuation of U.S. Ser. No. 06/845,167 filed Mar. 27, 1986 (now abandoned), all in the name of Hiroyasu Ogawa, Tetsuro Shigei and Tomoaki Kanno.

FIELD OF THE INVENTION

This invention relates to a method for producing graphite fiber, and in particular to a graphite fiber which has an improved adhesion property with a resin matrix of a composite and which is resistant to fluffing during the step of graphitizing treatment, resistant to loss of strength during surface treatment, easily accepts the effect of surface treatment, and allows the production of high-strength graphite fibers.

BACKGROUND OF THE INVENTION

Carbon fibers of the type produced by using fibers of acrylonitrile polymer or an acrylonitrile type polymer as a raw material are widely known and have already been put to practical use. The carbon fibers are generally obtained by preoxidizing the aforementioned raw material in an oxidizing atmosphere such as in air at from about 200° to 300° C., and further carbonizing the preoxidized fibers in an inert gas such as nitrogen, argon, or helium at from about 500° to 1,500° C. Graphite fibers are obtained by graphitizing the carbon fibers in an inert gas such as those described above at a temperature in the range of from about 2,000° to 3,500° C. In such a manner graphite fiber having a modulus of elasticity of from 35,000 to 70,000 kgf/mm$^2$ can be obtained.

The thus obtained carbon fibers or graphite fibers are combined with various thermosetting resins or thermoplastic resins such as epoxy resin or polyimide resin to produce light but strong composites to be used in the fields of sporting goods, aviation, and the space industry.

Conventional carbon fibers, however, have a tensile strength of 450 kgf/mm$^2$ at most. The graphite fibers obtained by graphitizing such carbon fibers acquire an increased tensile modulus of elasticity, and notably lose tensile strength to even less than 300 kgf/mm$^2$, a magnitude much smaller than the strength of carbon fibers. Inevitably it has been customary, therefore, to make a choice between carbon fibers and graphite fibers depending on the nature of use contemplated, as adopting carbon fibers for uses requiring strength, and graphite fibers for uses requiring elasticity.

In recent years, the desirability of supplying carbon fibers and graphite fibers combining still greater strength and still higher elasticity for various uses, such as in the aircraft and space industry, has been finding growing recognition with a view to utilizing improved performance.

It has been ascertained by the inventors through their study that graphite fibers, as compared with carbon fibers yet to be graphitized, are liable to lose adhesiveness with resin as a consequence of the development of the structure of graphite crystals. As means of enhancing the adhesiveness, there may be conceived an idea of oxidizing the surface of graphite fibers, similarly to that of carbon fibers, thereby make the surface of the structure of graphite crystals amorphous to some extent, and, at the same time, enabling the graphite fibers to produce a chemically functional group. In spite of this effort, it is still difficult to make graphite fibers manifest the effects of this surface treatment to advantage. Conversely, the effort brings about the disadvantage that the surface treatment performed using a high energy tends to cause a decline of the strength of fibers.

Further, since graphite fibers are inherently brittle, the bundle of graphite fibers during the course of manufacture inevitably produce fluff heavily. As a solution to this problem, there may be conceived a method of precluding the formation of fluff and the growth of fluff produced by applying a readily decomposable high molecular substance such as, for example, a polyoxyethylene polymer, water-soluble saturated polyester, nonionic surfactant, or butene polymer in advance on the bundle of carbon fibers as a raw material and then feeding the bundle to the step of graphitizing treatment. Unfortunately, this method is not sufficiently effective.

If an epoxy resin, unsaturated polyester, methyl cellulose, or carboxymethyl cellulose, for example, is used for the application on the bundle of carbon fibers with a view to precluding the occurrence of fluff and the growth of fluff formed at all, one encounters the problem that the produced bundle of graphite fibers is surface treated with increased difficulty and suffers from a loss of strength.

SUMMARY OF THE INVENTION

An object of the present invention is to provide a method for the production of graphite fibers which are resistant to a loss of strength during graphitizing treatment and during surface treatment given subsequent to the graphitizing treatment, exhibit high fiber strength, produce fluff minimally during various treatments, and excel in adhesiveness with a resin.

This invention is directed to a method for producing graphite fiber comprising graphitizing carbon fiber having a tensile strength of 500 kgf/mm$^2$ or more and a modulus of elasticity of from 27,000 to 33,000 kgf/mm$^2$, having at least on the surface of the fibers from 0.2 to 2% by weight of an epoxy resin as a sizing agent, from 0.005 to 0.10% by weight of silicon and 0.005 to 0.02% by weight of phosphorus based on the weight of carbon fiber having said epoxy resin, silicon and phosphorus.

DETAILED DESCRIPTION OF THE INVENTION

The carbon fiber used in this invention is obtained, for example, by preparing an acrylic fiber from a homopolymer of acrylonitrile or a copolymer containing 90% by weight or more of acrylonitrile, oxidizing the acrylic fiber in an oxidizing atmosphere such as air, generally at from about 200° to 300° C. under a tension of from about 20 to 300 mg/d (d:denier) for from about 0.1 to 2 hours thereby preoxidizing the fibers, and then carbonizing the preoxidized fibers in an inert gas such as a nitrogen gas at from about 1,300° to 1,800° C. under a tension of from about 10 to 300 mg/d for from about 0.1 to 10 minutes. Preferable preoxidizing conditions are from about 240° to 280° C., from about 50 to 200 mg/d and from about 0.5 to 1 hour, respectively, and preferable carbonizing conditions are from about 1300° to 1600° C., from about 50 to 200 mg/d and from about 0.5 to 5 minutes, respectively. Generally, fibers are in the form of a strand, preferably consisting of from about 100 to 100,000 filaments.

In order to supply silicon to carbon fiber of the present invention a silicon-containing compound, that is, a silicone surfactant or a mixture of a silicone surfactant and a silicone compound other than the surfactant can be used. The content of the silicone compound in the mixture is preferably less than 30% by weight. Examples of the silicone compound include an epoxy-denatured polysiloxane, an adduct of polysiloxane with polyethylene oxide, and a silicone oil.

The silicone surfactant to be used for the production of the carbon fiber of this invention is to be selected from the well-known silicon-containing surfactants such as polysiloxane surfactants, preferably aminopolysiloxane surfactants. Particularly desirably, it is a silicone surfactant containing amino groups and polyoxyalkylene groups in one molecule and represented by formula (I).

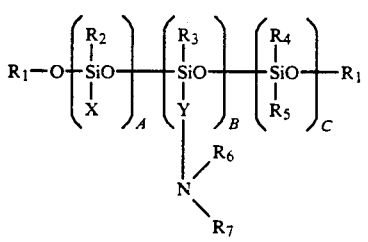

(I)

wherein $R_1$ through $R_7$ each represents H or a lower alkyl group preferably having from 1 to 3 carbon atoms, X is a polyoxyalkylene group, Y represents an alkylene group of from 1 to 10 carbon atoms or an arylene group of from 6 to 10 carbon atoms, and A, B, and C each represents a positive integer to make the molecular weight of the polysiloxane fall within the range of from about 1,000 to 100,000. Examples of the polyalkylene group represented by x include $$-(CH_2CH_2O)m(CH_2\underset{\underset{CH_3}{|}}{C}HO)nR$$

wherein R represents H or $-CH_3$, and m and n each represents an integer of from 0 to 10, provided that $m+n \geqq 1$, In order to apply phosphorous to carbon fiber of the present invention a phosphorous-containing compound, that is, a phosphorus-containing surfactant or a mixture of a phosphorus-containing surfactant and a phosphate can be used. The content of the phosphate in the mixture is preferably less than 30% by weight. An example of the phosphate is ammonium phosphate.

The phosphorus-containing surfactant is selected from the well known phosphorus-containing surfactants. Desirably, it is a quaternary ammonium phosphate of aminoethylalkyl ester and more preferably a monoalkylphosphoric ester (which is disclosed in U.S. Pat. No. 4,536,448), for example, or a mixture thereof.

The monoalkylphosphoric ester is represented by formula (A) or (B):

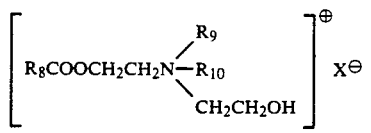

(A)

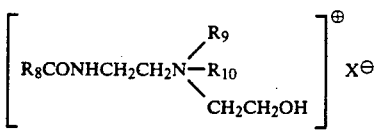

(B)

wherein $R_8$ represents an aliphatic hydrocarbon group having from 11 to 17 carbon atoms; $R_9$ and $R_{10}$ each represents hydrogen, a lower alkyl group preferably having from 1 to 3 carbon atoms, a hydroxyethyl group, or an hydroxyisopropyl group, and $X^{63}$ is a phosphate ion or a phosphoryl dioxy ethanol ion.

Examples of the ester include the following compounds.

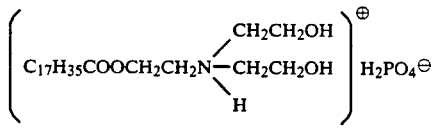

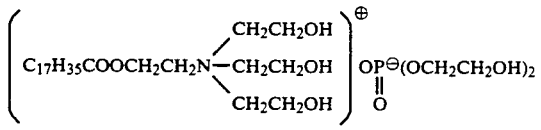

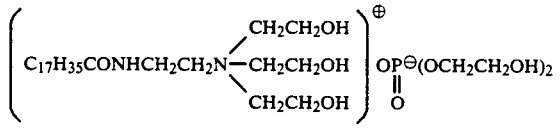

The epoxy resin which is used in the present invention contains at least one epoxy group in one molecule. Examples of the epoxy resin used in the present invention are disclosed, for example, in U.S. Pat. No. 4,420,512, and which include a glycidyl type epoxy resin and a non-glycidyl type epoxy resin. Specific examples of the glycidyl type epoxy resin are (1) bisphenol type epoxy resins obtained by the condensation of a bisphenol such as bisphenol A, bisphenol F, bisphenol S, and 2,2'-bis(4-hydroxyphenol)butane with epichlorohydrin, (2) phenol type epoxy resins obtained by the reaction of epichlorohydrin with novolak type phenol resins, (3) nitrogen-containing epoxy resins, (4) ester type epoxy resins obtained as copolymers of methacrylic acid glycidyl ester and ethylenic double bond-containing monomers (such as, for example, acrylonitrile, styrene, vinyl acetate, and vinyl chloride), and (5) epoxy resins obtained by the reaction of epichlorohydrin with ordinary polyols or polyethers.

Examples of the non-glycidyl type epoxy resin, include alicyclic epoxy resins, epoxidized butadiene, and epoxidized glyceride.

In order to obtain a sizing composition to use in the present invention, at least one of the epoxy resins described above is dissolved in a good solvent for epoxy resin such as, for example, acetone or methylethyl ketone. Otherwise, it may be used as first dissolved in a small amount of a solvent and then emulsified in any known emulsifiers such as, for example, ammonium alkylbenzenesulfonate, sodium dioctylsulfonate, and nonylphenolethylene oxide adduct, preferably a non-ionic emulsifier. It is preferable that the concentration of the epoxy resin in the composition is at least 20% by weight.

Other ingredients may be added to the sizing composition of the present invention. For example, it is possible to add lubricants (e.g., higher aliphatic amides such as maleic acid amide, stearic acid amide, etc., higher aliphatic alcohols such as oleyl alcohol, stearyl alcohol, cetyl alcohol, etc., silicone oil, fluorine-containing compounds, etc.), softening agents (e.g., polyoxyethylene stearic acid amide, polyoxyethylene stearyl ester, etc.), diluents (e.g., reactive diluents such as phenyl glycidyl ether, cresyl glycidyl ether, ethylene glycol diglycidyl ether, trimethylopropane triglycidyl ether, etc., and non-reactive diluents such as nonylphenol, tricresyl phosphate, etc.). These ingredients are added in proper amounts depending upon the end-use, with the total amount of the additive preferably being not more than 20 wt % based on the epoxy resin.

In the present invention, the tensile strength of the carbon fiber is not less than 500 kgf/mm$^2$. If the tensile strength is less than 500 kgf/mm$^2$, the decrease of tensile strength which occurs during the conversion of carbon fibers into graphite fibers is comparatively high. The modulus of elasticity of the carbon fiber is in the range of from 27,000 to 33,000 kgf/mm$^2$.

When the modulus of elasticity deviates from this range, the improvement of the modulus of elasticity of the graphite fibers produced from carbon fibers is not sufficient. In order to increase the modulus of elasticity of the graphite fibers to be sufficiently high the graphitization of carbon fibers must be carried out at a higher temperature, rendering the production of graphite fibers uneconomical. Moreover, in the graphite fibers produced using such a higher temperature an improved modulus of elasticity is obtained at a sacrifice of strength. Thus, the graphite fibers produced require more severe conditions for surface treatment to improve the adhesion property of the fibers to the resin, thereby exhibiting decreased strength.

The carbon fiber of the present invention has from 0.2 to 2% by weight of an epoxy resin as a sizing agent. When the amount of the epoxy resin is less than 0.2% by weight, breakage of monofilaments occurs heavily during the production of graphite fibers and the effect of bundling fibers cannot be obtained sufficiently, with the unfavorable result that the produced graphite fibers have increased fluffing. If the amount exceeds 2% by weight, the graphite fibers produced from the carbon fibers do not easily yield to surface treatment and then carbon fibers are liable to exhibit inferior adhesiveness in composites they form with resin. The preferable amount of the epoxy resin is from 0.4 to 1.5% by weight. When the amount of the epoxy resin is satisfied, the epoxy resin is enabled to fulfil its function of bundling the fibers during the conversion into graphite fibers and give rise to a graphite fiber of minimal fluff.

Even if the amount of the sizing agent falls in the range of from 0.2 to 2% by weight, the treatment of graphite fibers becomes difficult when the carbon fiber does not contain silicon and phosphorus in the specified amounts.

It is further necessary for the carbon fiber of this invention to contain silicon and phosphorus each in specified amounts. So long as the carbon fiber satisfies all these requirements, the graphite fiber produced therefrom does not entail the otherwise possible problems such as loss of strength, decline of modulus of elasticity, and loss of strength and adhesiveness due to surface treatment, and the graphite fiber enjoys fine quality and produces minimal fluff.

In the present invention silicon and phorphorus mean silicon element (or component) and phosphorus element, respectively. The surfactants containing the elements, the silicates or phosphates which are applied on the fiber, exist on and in the fiber as they are or they exist on and in the fiber as compounds different from the original compound applied, that is, in the form of compounds produced by conversion thereof during the preoxidation and/or carbonization process.

If the silicon content is less than 0.005% by weight, the graphite fibers converted from the carbon fiber are liable to acquire a rather insufficient modulus of elasticity, do not easily yield to surface treatment, and exhibit poor adhesiveness in composites they form with resin. If it exceeds 0.10% by weight, the graphite fibers produced have the drawback of heavily losing strength. The preferable amount of silicon is from 0.01 to 0.05% by weight.

Furthermore, for the sake of the various properties which the graphite fibers produced are allowed to acquire, the carbon fiber is further required to contain 0.005 to 0.02% by weight of phosphorus.

If the phosphorus content is less than 0.005% by weight, the decrease of strength during conversion of carbon fibers into graphite fibers is conspicuous. If it exceeds 0.02% by weight, the thermo-oxidation resistance of carbon fiber is not improved, and produced graphite fibers have the drawback of offering resistance to the surface treatment. The preferable amount of phosphorus is from 0.01 to 0.015% by weight.

In the present invention, it is particularly desirable for the ratio of the silicon to phosphorus contents (by weight), to fall within the range of from 0.3/1 to 6/1 preferably from 0.5/1 to 2/1, because the graphite fibers produced from the carbon fibers containing these elements in the ratio specified above have the advantage that the strength of the graphite fiber is high, the loss of strength during the surface treatment is small, and the adhesiveness exhibited in composites they form with resin is excellent.

The acrylic fiber which is used as a starting material for the graphite fiber of the present invention can contain at least one of Si and P, if desired, in an amount of from 0 to 2% by weight based on the fiber having Si and/or P. In this case, the remainder of the at least one of Si and P can be added to the fiber after the start of preoxidation but prior to graphitization.

Generally, the thickness of individual filaments of the carbon fiber of this invention falls in the range of from 3 to 8 $\mu$m, and preferably 3 to 6 $\mu$m, because a thickness in this range enables the loss of strength during conversion of carbon fibers into graphite fibers to be decreased notably.

In the present invention, the carbon fiber is preferably produced by impregnating an acrylic fiber with a surfactant containing silicon or the above-described mixture thereof and a surfactant containing phosphorus or the above-described mixture thereof, then preoxidizing the acrylic fiber, and subsequently carbonizing the prescribed fiber so as to impart to the carbon fiber produced a tensile strength exceeding 500 kgf/mm$^2$ and a modulus of elasticity in the range of from 27,000 to 33,000 kgf/mm$^2$. The carbon fiber so produced is easily subjected to surface treatment and in composites it forms with resin, exhibits high adhesiveness. Thus, the carbon fibers prove to be useful particularly for composites.

A typical method by which the carbon fiber used in this invention is produced will be described below.

A homopolymer of acrylonitrile or a polymer obtained by copolymerizing not less than 90% by weight, preferably from 95 to 99% by weight, of acrylonitrile with at least one comonomer preferably selected from the group consisting of neutral comonomers (such as, for example, methyl esters and ethyl esters of acrylic acid and methacrylic acid, acrylamide, and vinyl acetate known to the art), acidic comonomers (such as, for example, acrylic acid, itaconic acid, methacrylic acid, allylsulfonic acid, methacrylsulfonic acid, and salts thereof known to the art), and basic comonomers (such as, for example, vinyl pyridine, vinyl imidazole, and salts thereof known to the art) is dissolved in a concentration of about from 5 to 30% by weight in a solvent selected from the group consisting of dimethylformamide, dimethylacetamide, dimethylsulfoxide, an aqueous zinc chloride solution, an aqueous nitric acid solution, or an aqueous rhodan salt solution. The resultant polymer solution is forced through a nozzle having from about 100 to 100,000 orifices of from 0.01 to 0.1 mm in diameter into a dilute solution of the aforementioned solvent (coagulating bath) either directly or indirectly via the ambient air to produce a fiber. Then, the fiber is washed with water to remove the solvent, and, during the removal of the solvent, stretched to from 2 to 5 times the original size. Optionally, it is then dried to effect densification of a filament. Subsequently, the above-described silicon-containing compound and the above-described phosphorus-containing compound, used either independently of each other or jointly in the form of mixture, is/are applied to the fiber so that the carbon fiber eventually produced will satisfy all the requirements described in this invention.

After that, if the drying for densifying the filament has not yet been carried out, the fiber is dried at a temperature in the range of from 60° to 150° C.

The thus obtained fiber is then stretched to from 2 to 10 times the original size in saturated steam at from 100° to 160° C. to produce an acrylic fiber consisting of monofilaments of from 0.1 to 2 deniers in thickness. The above-described silicon-containing compound and the phosphorus-containing compound, used either independently of each other or jointly in the form of a mixture, are applied during the aforementioned step in the production of acrylic fibers, and, after the acrylic fibers have been subsequently converted to preoxidized fibers and further to carbon fibers, they may be applied by way of replenishment into the preoxidized fiber or carbon fiber, so that the carbon fiber finally produced fulfills all of the requirements imposed by this invention.

The compounds may also be applied to fiber after production of preoxidized fiber or carbon fiber. However, it is preferable to apply them during or after preparation of acrylic fiber to obtain fibers having excellent mechanical properties by providing thermo-oxidation resistance to the fibers.

Generally, this application is effected by dipping the fiber in a solution of the compounds or spraying it with the solution generally at a temperature in the range of from about 20° to 60° C. The acrylic fiber so treated is generally preoxidized in a preoxidizing furnace provided with a group of multistage rollers, with the temperature, the retention time, and the tension properly adjusted for the fiber to acquire a specific gravity in the range of from 1.3 to 1.45 (as the preoxidized fiber per se), to produce a preoxidized fiber. Subsequently, in a well known carbonizing furnace such as a vertical carbonizing furnace having the lower part thereof sealed with water, the preoxidized fiber is treated under the aforementioned conditions and consequently converted into carbon fiber.

When compounds are applied to a preoxidized fiber or a carbon fiber the application may be conducted in the same manner as described hereinabove. When the carbon fibers so produced are to be utilized for the production of composites, they are, preferably, after having been given a surface treatment, further passed through a solution or an aqueous dispersion of the sizing composition, and dried at from about 100° to 150° C. for from about 1 to 10 minutes, to provide a carbon fiber according to the present invention. The phosphorus and the silicon which have been applied to the fiber are present at least on the surface of the carbon fiber. It is preferable that they are on the surface, however, a part of them may also be present within the fiber by penetration.

The surface treatment is conducted to improve the adhesive property of the carbon fiber to resins which are used for production of a composite.

Any conventional physical or chemical surface treatment can be applied provided that it improves the adhesion property of carbon fiber. Typical methods include a method using electrolysis of the carbon fiber as described, for example, in U.S. Pat. No. 4,401,533; a treatment using chemicals such as an oxidizing agent e.g., a peroxide, an alkali metal permanganate, an alkali metal perchlorate and nitric acid; and a dry method such as a heat treating method of carbon fiber in a $NO_2$ gas or in air at 300° C. or higher.

The thus-obtained carbon fiber can be used for preparing a composite having excellent adhesiveness with the resin matrix such as a thermosetting resin (e.g., an epoxy resin, an unsaturated polyester, a polyimide, a phenol resin) and a thermoplastic resin (e.g., a polysulfone resin, a polyetheretherketone resin, a polycarbonate and a polyamide). Thus, it permits production of materials possessing extremely high strength.

When the carbon fiber is subjected to production of a graphite fiber of the present invention, amounts of silicon and the phosphorous content of the carbon fiber are adjusted by supplying or applying compounds containing silicon and/or phosphorous, and furthermore the sizing agent of the present invention is applied to the carbon fiber in the same manner as described hereinabove. The compounds containing silicon and phosphorous may be incorporated in the sizing composition.

When the thus treated carbon fiber is graphitized, a graphite fiber which possesses a high strength and a high modulus of elasticity, produces substantially no fluff, and exhibits satisfactory adhesiveness with resin can be obtained.

Graphitization can be carried out in a conventional method, e.g., the carbon fiber is heated at from about 2,000° to 3,500° C. in an inert gas such as nitrogen or argon gas under a tension of from about 10 to 300 mg/d for from about 0.5 to 20 minutes.

Particularly in the aircraft and space field, the carbon fiber of this invention is useful as a material which provides high strength and elasticity, and allows for weight reduction.

The effects which various carbon fibers manifest during their conversion into graphite fiber are summarized in Table 1. It is noted from the data that when the carbon fiber of this invention is graphitized, there is obtained a graphite fiber which has not admitted of either loss of strength during the graphitization or loss of strength during the surface treatment, excels in adhesiveness with resin, produces fluff only minimally, and possesses a high modulus of elasticity. Table 1 shows the results of an experiment performed by following the procedure of Example 1, with necessary modifications.

(2) The surface treatment of given carbon fiber or graphite fiber was carried out in accordance with the electolytic method, i.e., by using the fiber as an anode and the electrolyte (10% caustic soda aqueous solution) as a cathode. A DC voltage was applied: in the case of carbon fiber, at a current density of 0.5 A/m$^2$ and, in the case of graphite fiber of a modulus of elasticity in the range of from 40,000 to 44,000 kgf/mm$^2$, at a current density of 0.8 A/mm$^2$ and; in the case of graphite fiber of a modulus of elasticity in the range of from 45,000 to 49,000 kgf/mm$^2$, at a current density of 1.2 A/m$^2$. In the foregoing m$^2$ represents the surface areas of the fiber immersed in liquid.

(3) The amount of fluff was rated by visual observations.

TABLE 1

| Carbon fiber | | | | | Graphite fiber Surface treatment | | | | |
|---|---|---|---|---|---|---|---|---|---|
| | | | | | Before | | After | | |
| Strength (kgf/mm$^2$) | Modulus of elasticity (kg/mm$^2$ × 10$^3$) | Amount of sizing agent deposited (%) | Silicon content (%) | Phosphorus content (%) | Strength lowered (kgf/mm$^2$)*1 | Modulus of elasticity (kgf/mm$^2$ × 10$^3$) | Strength lowered (kgf/mm$^2$)*2 | ILSS of composite (kgf/mm$^2$) | Amount of fluff |
| <500 | 27-33 | 0.2-2 | 0.005-0.10 | 0.005-0.02 | 90-110 | 40 | 60-70 | 10.5-10.8 | Slight |
| >500 | <27 | 0.2-2 | 0.005-0.10 | 0.005-0.02 | 120-140 | 38 | 60-70 | 10.5-10.8 | " |
| | 27-33 | <0.2 | <0.005 | <0.005 | 110-130 | 40 | 100-110 | 10.5-10.8 | Very heavy |
| | | | 0.005-0.10 | 0.005-0.02 | 120-140 | 40 | 100-110 | 10.5-10.8 | Very heavy |
| | | 0.2-2 | <0.005 | <0.005 | 90-110 | 40 | 60-70 | 9.0-9.3 | Slight |
| | | | | 0.005-0.02 | 70-90 | 39 | 60-70 | 6.5-6.8 | " |
| | | | 0.005-0.10 | <0.005 | 90-100 | 40 | 60-70 | 9.4-9.6 | " |
| | | | 0.005 | 0.017-0.012 | 40-60 | 40 | 60-70 | 10.0-10.3 | Slight*3 |
| | | | 0.005-0.03 | 0.005-0.015 | 40-60 | 40 | 40-50 | 10.0-10.3 | " |
| | | | 0.03-0.10 | 0.005 | 40-60 | 40 | 40-50 | 10.5-10.7 | " |
| | | | 0.005-0.10 | >0.02 | 40-60 | 38 | 60-70 | 6.5-6.7 | Slight |
| | | | >0.10 | <0.005 | 150-170 | 40 | 60-70 | 9.0-9.3 | " |
| | | | | 0.005-0.02 | 130-140 | 40 | 60-70 | 9.5-9.8 | " |
| | | >2 | 0.005-0.10 | 0.005-0.02 | 40-60 | 40 | 60-70 | 6.0-6.3 | " |

(Note)
*1(Strength of carbon fiber) − (strength of graphite fiber)
*2(Strength before surface treatment) − (strength after surface treatment)
*3Examples of this invention The composite is prepared by a conventional method. Generally, the fiber is impregnated with a resin solution or a molten resin to obtain prepregs, and after solidification of the resin, the prepregs are accumulated and heat-pressed to obtain a composite having a desired shape. The fiber content in the composite is usually from 20 to 75% by volume.

Now, the present invention will be described more specifically below with reference to working examples. Wherever "%" and "parts" mentioned, they mean proportions by weight unless otherwise specified.

(1) In Examples and comparative Examples, tensile strength and modulus of elasticity were measured by following the procedure of JIS R-7601, with necessary modifications and interlayer shear strength (ILSS) of the composite was measured by the procedure of ASTM D 2344 with respect to a composite obtained by impregnating an array of given carbon fibers or graphite fibers arranged in one direction with an epoxy resin composed of 60 parts of Epikote 828 and 36.5 parts of Epikote 154 (both are diglycidylethers of bisphenol A, and are products of Yuka Shell Epoxy Co., Ltd.) and 35 parts of dicyandiamide to such an extent that the resin content of the composite would reach 40%, then superposing the resultant sheetlike prepregs in a direction of 0° with respect to the direction of the length of the fiber, and laminating them at 135° C. for 2 hours under a pressure of 7 kg/cm$^2$.

EXAMPLES 1-2 AND COMPARATIVE EXAMPLES 1-3

A copolymer (molecular weight 80,000) consisting of 97% of acrylonitrile, 2% of methyl acrylate, and 1% of itaconic acid was dissolved in a concentration of 10% in a 60% zinc chloride aqueous solution. The resultant solution was kept at 45° C. and forced through a nozzle having 6,000 orifices of 0.07 mm in diameter into an aqueous 30% zinc chloride solution. The fibers thus-produced were stretched to 4 times the original size during washing with water to effect removal of the solvent and then, still in a state swelled with water, immersed in an aqueous dispersion containing, in a varying concentration, i.e., 1 g/liter, 5 g/liter, or 10 g/liter, a mixture of aminopolyoxypolysiloxane of the aforementioned general formula [1] ($R_1$=H, $R_{1-5}$=$CH_3$, $R_{6,7}$=H, Y=-$CH_2$; molecular weight: 20,000 and silicon content: 35%) having an amino group content of 0.8% per molecule and containing 10% of an oxyethylene group of a molecular weight of 1,500 with a quaternary ammonium phosphate of dihydroxyaminoethyl stearate (phosphorus content: 5%) for the purpose of deposition on the fibers. Then, the fibers were continuously dried at 100° C. for 5 minutes and at 130° C. for 3 minutes, stretched to 6 times the original size in saturated steam of 135° C., to produce acrylic fiber consisting of 6,000 monofilaments having a 1 denier(d) thickness, and having a tensile strength of 8 g/d and an elongation of 15%.

This fiber was treated in the air under the conditions of 230° C., 30 minutes, and 200 mg/d of tension and the conditions of 250° C., 15 minutes, and 250 mg/d of tension to produce preoxidized fiber. Subsequently, the preoxidized fiber was treated at 1,500° C. for 3 minutes at a tension of 200 mg/d in nitrogen gas, to provide carbon fiber as shown in Table 2.

By depositing a sizing agent (Epikote 828) in an amount of 1.0% on this carbon fiber, there was obtained a carbon fiber of this invention (Table 2).

Then, this carbon fiber was graphitized at 2,800° C. for 3 minutes at a tension of 100 mg/d under a current of argon, to produce graphite fibers having a monofilament thickness of 0.5 micron. The properties of this graphite fibers were as shown in Table 2. From the data set forth in Table 2, it is noted that the graphite fibers obtained from the carbon fibers acording to this invention exhibit excellent properties with less fluff.

TABLE 3

| | Carbon fiber Amount of sizing agent deposited (%) | Graphite fiber Surface treatment Before: Strength lowered (kgf/mm²)*1 | Before: Modulus of elasticity (kgf/mm² × 10³) | After: Strength lowered (kgf/mm²)*2 | After: ILSS of Composite (kgf/mm²) | Amount of fluff |
|---|---|---|---|---|---|---|
| Comparative Example 4 | 0.1 | 115 | 46.3 | 87 | 10.1 | Very heavy |
| Example 3 | 0.5 | 70 | 46.2 | 61 | 10.3 | Slight |
| Example 4 | 1.5 | 68 | 46.3 | 60 | 10.1 | Slight |
| Comparative Example 5 | 3.0 | 62 | 46.1 | 60 | 6.0 | Slight |
| Comparative Example 6 | 1.0 | 80 | 46.1 | 60 | 7.5 | Heavy |
| Comparative Example 7 | 1.0 | 130 | 46.0 | 70 | 7.0 | Slight |
| Comparative Example 8 | 1.0 | 68 | 46.3 | 63 | 10.3 | Very heavy |

(1) *1 and *2 are the same as in Table 1
(2) In Comparative Experiment 6, polyvinyl alcohol was used as a sizing agent.
In Comparative Experiment 7, polyacrylamide was used as a sizing agent
In Comparative Experiment 8, polyethylene oxide (n = 100) was used as a sizing agent. (n: polymerization degree)

TABLE 2

| | Carbon fiber: Strength (kgf/mm²) | Carbon fiber: Modulus of elasticity (kg/mm² × 10³) | Carbon fiber: Amount of sizing agent deposited (%) | Carbon fiber: Silicon content (%) | Carbon fiber: Phosphorus content (%) | Graphite fiber Surface treatment Before: Strength lowered (kgf/mm²)*1 | Before: Modulus of elasticity (kgf/mm² × 10³) | After: Strength lowered (kgf/mm²)*2 | After: ILSS of composite (kfg/mm²) | Amount of fluff |
|---|---|---|---|---|---|---|---|---|---|---|
| Comparative Example 1 | 530 | 28.1 | 1.0 | 0.004 | 0.002 | 90 | 43 | 75 | 9.2 | Slight |
| Example 1 | 532 | 28.3 | 1.0 | 0.071 | 0.018 | 48 | 43 | 56 | 10.5 | " |
| Example 2 | 532 | 28.3 | 1.0 | 0.100 | 0.0051 | 58 | 43 | 58 | 10.5 | " |
| Comparative Example 2 | 530 | 28.4 | 1.0 | 0.140 | 0.008 | 149 | 43 | 69 | 9.0 | " |
| Comparative Example 3 | 528 | 28.3 | 1.0 | 0.135 | 0.024 | 130 | 42 | 78 | 9.6 | " |

*1 and *2 are the same as in Table 1

EXAMPLES 3-4 AND COMPARATIVE EXAMPLES 4-8

Carbon fiber of the present invention were produced by following the procedure of Example 1, except that Epikote 154 was used as an epoxy resin, an aqueous dispersion emulsified with 10% of nonylphenol-polyehtylene glycol (polymerization degree: 40) ether was used as an emulsifier, and the amount of the sizing agent deposited was varied to 0.1, 0.5, 1.5, and 3.0% as solids.

For comparison, carbon fiber were obtained in the same manner as described above except applying 1.0% each of polyvinyl alcohol (MW: about 500), polyacylamide (MW: about 2,000), and polyethylene oxide (MW: about 4,400) as sizing agents.

These carbon fiber were graphitized at 2,950° C. for 3 minutes, at a tension of 50 mg/d under a current of argon, to be converted into graphite fiber.

The aforementioned carbon fiber of this invention had a strength of 530 kgf/mm², a modulus of elasticity of 28,300 kgf/mm², a silicon content of 0.03%, a phosphorus content of 0.008%, and a silicon/phosphorus ratio of 3.75. The graphite fiber obtained from these carbon fiber possessed properties and fluff as shown in Table 3.

EXAMPLE 5

Carbon fiber was obtained by following the procedure of Example 1. This carbon fiber was subjected to surface treatment at a current density of 1 A/m² for 3 minutes (with a 10% caustic soda aqueous solution used as an electrolyte and carbon fiber used as an anode). A composite using the carbon fiber after the surface treatment (treated fiber) and a composite using the carbon fiber before the surface treatment (untreated fiber) were tested for ILSS.

The values of ILSS were 7.9 kgf/mm$^2$ for the untreated fiber and 10.9 kgf/mm$^2$ for the treated fiber. When this comparative test on ILSS was performed on the carbon fiber obtained in Comparative Example 3, the values of ILSS were 7.0 kgf/mm$^2$ for the untreated fiber and 10.0 kgf/mm$^2$ for the treated fiber. From these results, it is noted that the carbon fiber of the present invention exhibited higher adhesiveness than the carbon fiber of the comparative experiments.

EXAMPLE 6

The same procedure was conducted as in Example 1 except that the amount of each compound added to the carbon fiber (raw material) was changed as shown in Table 4 below. The properties of the graphite fiber after the surface treatment are shown in the same Table.

TABLE 4

| Run No. | Carbon Fiber: Epoxy Resin (%) | Carbon Fiber: Si (%) | Carbon Fiber: P (%) | Graphite Fiber: Tensile Strength Lowered (kgf/mm$^2$) | Graphite Fiber: Tensile Modulus of Elasticity ($10^3$ kgf/mm$^2$) | Graphite Fiber: ILSS (kgf/mm$^2$) | Graphite Fiber: Tensile Strength (kgf/mm$^2$) |
|---|---|---|---|---|---|---|---|
| 1. (Inv.) | 1.0 | 0.080 | 0.009 | 84 | 43 | 10.5 | 452 |
| 2. (Comp.) | 0 | 0.080 | 0.009 | 140 | 42 | 10.4 | 396 |
| 3. (Comp.) | 1.0 | 0.002 | 0.002 | 149 | 43 | 9.2 | 387 |

Properties of carbon fiber used as a raw material were as follows:

Tensile Strength: 536 kgf/mm$^2$

Tensile Modulus of Elasticity: $28.5\times10^3$ kgf/mm$^2$

As can be seen in Table 4, when only the combination of Si and P was used (Run No. 2) the strength of the graphite fiber obtained was low. On the other hand, when the epoxy resin was used in combination with Si and P in small amounts (less than the lower limits of the present invention) (Run No. 3) the reduction of the strength was high and both the strength and the ILSS of the graphite fiber obtained were low.

However, when an epoxy resin was used in combination with Si and P (Run No. 1: amounts were within the range of the present invention) both the strength and ILSS were high.

EXAMPLE 7

The same procedure was conducted as in Example 1, except that the amount of each compound added to the carbon fiber was changed as shown in Table 5 below. The properties of the graphite fiber before and after the surface treatment are also shown in the Table.

TABLE 5

| Run No. | Carbon Fiber: Silicone Content*1 (%) | Carbon Fiber: Phosphorus Content*2 (%) | Graphite Fiber Surface Treatment, Before: Tensile Strength (kgf/mm$^2$) | Before: Modulus of Elasticity ($10^3$ kgf/mm$^2$) | After: Tensile Strength (kgf/mm$^2$) | After: ILSS of Composite (kgf/mm$^2$) | Total Strength Lowered (kgf/mm$^2$) | Remarks |
|---|---|---|---|---|---|---|---|---|
| 1 | 0.100 | 0.0051 | 482 | 43 | 424 | 10.5 | 108 | Invention |
| 2 | [0.156] ↑ | 0.0051 | 444 | 43 | 382 | (9.8) | (148) | Si was excess |
| 3 | [0.002] ↓ | 0.018 | 478 | 42 | 418 | (9.6) | 113 | Si was too little |
| 4 | 0.005 | 0.018 | 478 | 43 | 417 | 10.3 | 113 | Invention |
| 5 | 0.071 | [0.0020] ↓ | 444 | 42 | 386 | 10.0 | (146) | P was too little |
| 6 | 0.071 | 0.0051 | 468 | 43 | 412 | 10.5 | 120 | Invention |
| 7 | 0.071 | 0.020 | 488 | 43 | 434 | 10.5 | 97 | Invention |
| 8 | 0.071 | [0.032] ↑ | 490 | 43 | 417 | (9.5) | 115 | P was excess |

*1 0.005 to 0.10% in the Invention
*2 0.005 to 0.02% in the Invention

The properties of carbon fiber used as a raw material were as follows:

Tensile Strength: 530 kgf/mm$^2$

Tensile Modulus of Elasticity: $28.2\times10^3$ kgf/mm$^2$

The amount of the epoxy resin was 0.1%.

In Table 5, [ ] ↑ shows that the amount of Si and P was larger than the upper limit of the present invention, and [ ] ↓ shows that the amount of Si or P was less than the lower limit of that of the present invention.

The ILSS value and the values of the total strength lowered shown in parenthesis show that the results were inferior to those of the present invention.

While the invention has been described in detail and with reference to specific embodiments thereof, it will be apparent to one skilled in the art that various changes and modifications can be made therein without departing from the spirit and the scope thereof.

What is claimed is:

1. A method for producing a surface treated graphite fiber comprising graphitizing carbon fiber having a tensile strength of 500 kgf/mm$^2$ or more and a modulus of elasticity of from 27,000 to 33,000 kgf/mm$^2$, and having at least on the surface of the fibers, from 0.2 to 2% by weight of an epoxy resin as a sizing agent, from 0.005 to 0.10% by weight of silicon and 0.005 to 0.02% by weight of phosphorus based on the weight of carbon fiber having said epoxy resin, silicon and phosphorus, wherein the carbon fiber is graphitized at from 2,000° to 3,500° C. in an inert gas, and then subjecting the graphitized fiber to a surface treatment, wherein phosphorous is applied as a material selected from the group consisting of a phosphorus containing surfactant and a mixture of a phosphorus containing surfactant and a phosphate, and wherein said phosphorus containing surfactant is selected from the group of compounds represented by formulae (A) or (B);

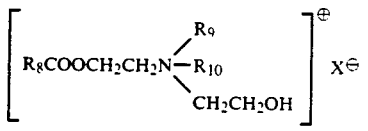

(A)

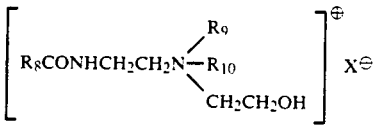

(B)

wherein $R_8$ represents an aliphatic hydrocarbon groups having from 11 to 17 carbon atoms; $R_9$ and $R_{10}$ each represents a hydrogen atom, a lower alkyl group preferably having from 1 to 3 carbon atoms, a hydroxyethyl group, or an hydroxyisopropyl group, and X is a phosphate ion or a phosphoryl dioxy ethanol ion.

2. A method for producing graphite fiber as in claim 1, wherein the carbon fiber is obtained by pre-oxidizing an acrylic fiber and carbonizing the thus-obtained preoxidized fiber.

3. A method for producing graphite fiber as in claim 2, wherein the acrylic fiber comprises a polymer containing at least 90% by weight of acrylonitrile.

4. A method for producing graphite fiber as in claim 1, wherein the amount of phosphorous is from 0.005 to 0.015%.

5. A method for producing graphite fiber as in claim 1, wherein the carbon fiber has a thickness of from 3 to 8 microns.

6. A method for producing graphite fiber as in claim 1, wherein the carbon fiber has a thickness of from 3 to 6 microns.

7. A method for producing graphite fiber as in claim 1, wherein the silicon is applied as a material selected from the group consisting of a silicon-containing surfactant and a mixture of a silicon-containing surfactant and a silicone compound.

8. A method for producing graphite fiber as in claim 7, wherein said silicon-containing surfactant is represented by formula (I):

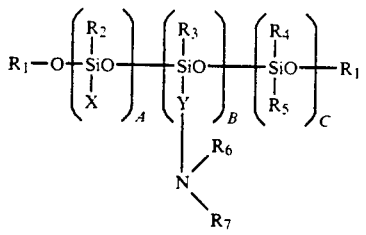

(I)

wherein $R_1$ through $R_7$ each represents H or a lower alkyl group, X is a polyoxyalkylene group, Y represents an alkylene group of from 1 to 10 carbon atoms or an arylene group of from 6 to 10 carbon atoms, and A, B, and C each represents a positive integer to make the molecular weight of the polysiloxane fall within the range of from about 1,000 to 100,000.

9. A method for producing graphite fiber as in claim 1, wherein the ratio of the content of silicon to the content of phosphorus (by weight) is from 0.3/1 to 6/1.

10. A method for producing graphite fiber as in claim 1, wherein the carbon fiber is produced by carbonizing preoxidized fiber obtained by preoxidizing acrylic fiber and having, at least on the surface of the preoxidized fibers, silicon and phosphorus in amounts such that the carbon fiber produced will have 0.005 to 0.10% by weight of silicon and from 0.005 to 0.02% by weight of phosphorus, carbonizing the thus-obtained preoxidized fiber, and applying to the thus-obtained carbon fiber an epoxy resin sizing agent in an amount of from 0.2 to 2% by weight, said amounts being based on the weight of the thus-obtained carbon fiber.

11. A method for producing graphite fiber as in claim 1, wherein after the graphitization a surface treatment for improving adhesion property of graphite fiber is conducted.

12. A method for producing graphite fiber as in claim 10, wherein at least one of silicon and phosphorus is applied to the fiber after preoxidation and before graphitization.

13. A method for producing graphite fiber as in claim 10, wherein carbon fiber is graphitized under a tension of from 10 to 300 mg/d.

14. A method for producing graphite fiber as in claim 1, wherein the amount of phosphorus is from 0.01 to 0.015%.

15. A method for producing graphite fiber as in claim 10, wherein the carbon fiber has a thickness of from 3 to 8 microns.

16. A method for producing graphite fiber as in claim 1, wherein the carbon fiber is graphitized under a tension of from 10 to 300 mg/d.

* * * * *